US011428057B2

(12) United States Patent
Moberg et al.

(10) Patent No.: US 11,428,057 B2
(45) Date of Patent: Aug. 30, 2022

(54) DECK WRENCH DISENGAGE WITH PIPE UNSCREWED INTERLOCK

(71) Applicant: Caterpillar Global Mining Equipment LLC, Denison, TX (US)

(72) Inventors: Carl J. Moberg, Dunlap, IL (US); Ross L. Hoult, Eight Mile Plains (AU)

(73) Assignee: Caterpillar Global Mining Equipment LLC, Denison, TX (US)

( * ) Notice: Subject to any disclaimer, the term of this patent is extended or adjusted under 35 U.S.C. 154(b) by 101 days.

(21) Appl. No.: 16/811,866

(22) Filed: Mar. 6, 2020

(65) Prior Publication Data

US 2021/0277731 A1 Sep. 9, 2021

(51) Int. Cl.

| | |
|---|---|
| ***E21B 19/16*** | (2006.01) |
| ***E21B 19/18*** | (2006.01) |
| *E21B 7/02* | (2006.01) |

(52) U.S. Cl.

CPC ..... *E21B 19/165* (2013.01); *E21B 19/161* (2013.01); *E21B 19/18* (2013.01); *E21B 7/02* (2013.01)

(58) Field of Classification Search

CPC ..... E21B 19/165; E21B 19/161; E21B 19/167
See application file for complete search history.

(56) References Cited

U.S. PATENT DOCUMENTS

| | | | | |
|---|---|---|---|---|
| 3,613,805 | A | 10/1971 | Lindstad et al. | |
| 3,881,375 | A | 5/1975 | Kelly | |
| 6,298,926 | B1 | 10/2001 | Dalkert et al. | |
| 10,132,157 | B2 | 11/2018 | Kuckes | |
| 2002/0170720 | A1* | 11/2002 | Haugen | E21B 19/00 166/379 |
| 2012/0152530 | A1* | 6/2012 | Wiedecke | E21B 19/10 166/250.01 |
| 2014/0338973 | A1 | 11/2014 | Taylor et al. | |
| 2015/0315855 | A1* | 11/2015 | Dewald | E21B 33/0422 166/250.01 |
| 2019/0257161 | A1* | 8/2019 | Dewald | E21B 19/07 |

FOREIGN PATENT DOCUMENTS

AU 2014221483 B2 11/2017

* cited by examiner

*Primary Examiner* — Giovanna Wright
(74) *Attorney, Agent, or Firm* — von Briesen & Roper, s.c.

(57) ABSTRACT

In accordance with one aspect of the present disclose, an interlock system for a mobile drilling machine. The interlock system has a sensor assembly used to determine a drill string status, an operator interface for receiving a deck wrench disengagement input, and a control module. The control module may be used to receive the deck wrench disengagement input from the operator interface, receive the drill string status from the sensor assembly, determine from the drill string status that a drill string component engaged by the deck wrench is connected to a drill string or a drill head, and disengage the deck wrench from the drill string component engaged by the deck wrench.

15 Claims, 11 Drawing Sheets

DECK WRENCH DISENGAGE WITH PIPE UNSCREWED INTERLOCK

TECHNICAL FIELD

The present disclosure generally relates to mobile drilling machines, and more specifically, to systems and methods of operating an interlock in a mobile drilling machine.

BACKGROUND

This section is intended to provide a background or context of the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Mobile drilling machines, such as blasthole mobile drilling machines, are generally known to include a vertical drill tower (e.g. mast, etc.) constructed from structural members such as steel beams and reinforcing supports. The drill tower is often coupled to a mobile platform (e.g. which along with other components typically form a drilling rig) for positioning the drill tower in a desired location to conduct a drilling operation. The drill tower is often adapted to support a drill string formed from a combination of drills string components (e.g., drill pipes, drill rods, drill extenders, etc.).

Throughout the drilling operation, it is often desirable or necessary to add or remove a drills string component from the drill string in order to meet a desired drilling depth, such as the depth that is greater or deeper than the depth restricted by the length of the drill tower. To prevent the drill string from falling into a drill hole when the drills string components are added or removed, a deck wrench is often utilized to engage and hold a drill string so it may be screwed or unscrewed. When the drill string is unscrewed, there is a risk of unintentional disengagement of the deck wrench.

The prior art has failed to adequately address this issue. US Patent App. No. 2014/0338973 A1, entitled, "Automatic Drill Pipe Add and Remove System," discloses a drilling rig carousel assembly that includes a drilling rig carousel that has a plurality of slots for holding drill components. The assembly also has sensors to determine whether the drill components are in the correct position before being automatically added to a drill string.

However, it is still possible for deck wrench to be disengaged by an operator when a drill component is not attached. Therefore, a system is needed which prevents the accidental disengagement of the deck wrench without the high cost of an automatic system.

SUMMARY

In one aspect, the present disclosure relates to an interlock system for a mobile drilling machine. The interlock system has a sensor assembly used to determine a drill string status, an operator interface for receiving a deck wrench disengagement input, and a control module. The control module may be used to receive the deck wrench disengagement input from the operator interface, receive the drill string status from the sensor assembly, determine from the drill string status that a drill string component engaged by the deck wrench is connected to a drill string or a drill head, and to disengage the deck wrench from the drill string component engaged by the deck wrench.

In another aspect, the present disclosure relates to a mobile drilling machine. The mobile drilling machine has a mobile frame, a drill mast mounted on the frame, a drill head movably mounted on the mast, a drill string coupled to the drill head and aligned with the mast, a deck wrench mounted on the frame configured to engage the drill string, and an interlock system, the interlock system including. The interlock system has a sensor assembly used to determine a drill string status, an operator interface for receiving a deck wrench disengagement input, and a control module. The control module may be used to receive the deck wrench disengagement input from the operator interface, receive the drill string status from the sensor assembly, determine from the drill string status that a drill string component engaged by the deck wrench is connected to a drill string or a drill head, and to disengage the deck wrench from the drill string component engaged by the deck wrench.

Further, one aspect of the present disclosure may include a method for providing a digital interlock for a mobile drilling machine. The method may include receiving a deck wrench disengagement input at an operator interface, receiving at a control module the deck wrench disengagement input from the operator interface, receiving a drill string status at the control module from a sensor assembly, determining from the drill string status that a drill string component engaged by the deck wrench is connected to a drill string or a drill head, and disengaging the deck wrench from the drill string component.

These and other aspects and features of the present disclosure will be more readily understood when read in conjunction with the accompanying drawings.

While the present disclosure is susceptible to various modifications and alternative constructions, certain illustrative embodiments thereof will be shown and described in detail. The disclosure is not limited to the specific embodiments disclosed, but instead includes all modification, alternative constructions, and equivalents thereof.

DETAILED DESCRIPTION OF THE DRAWINGS

Figure 1:
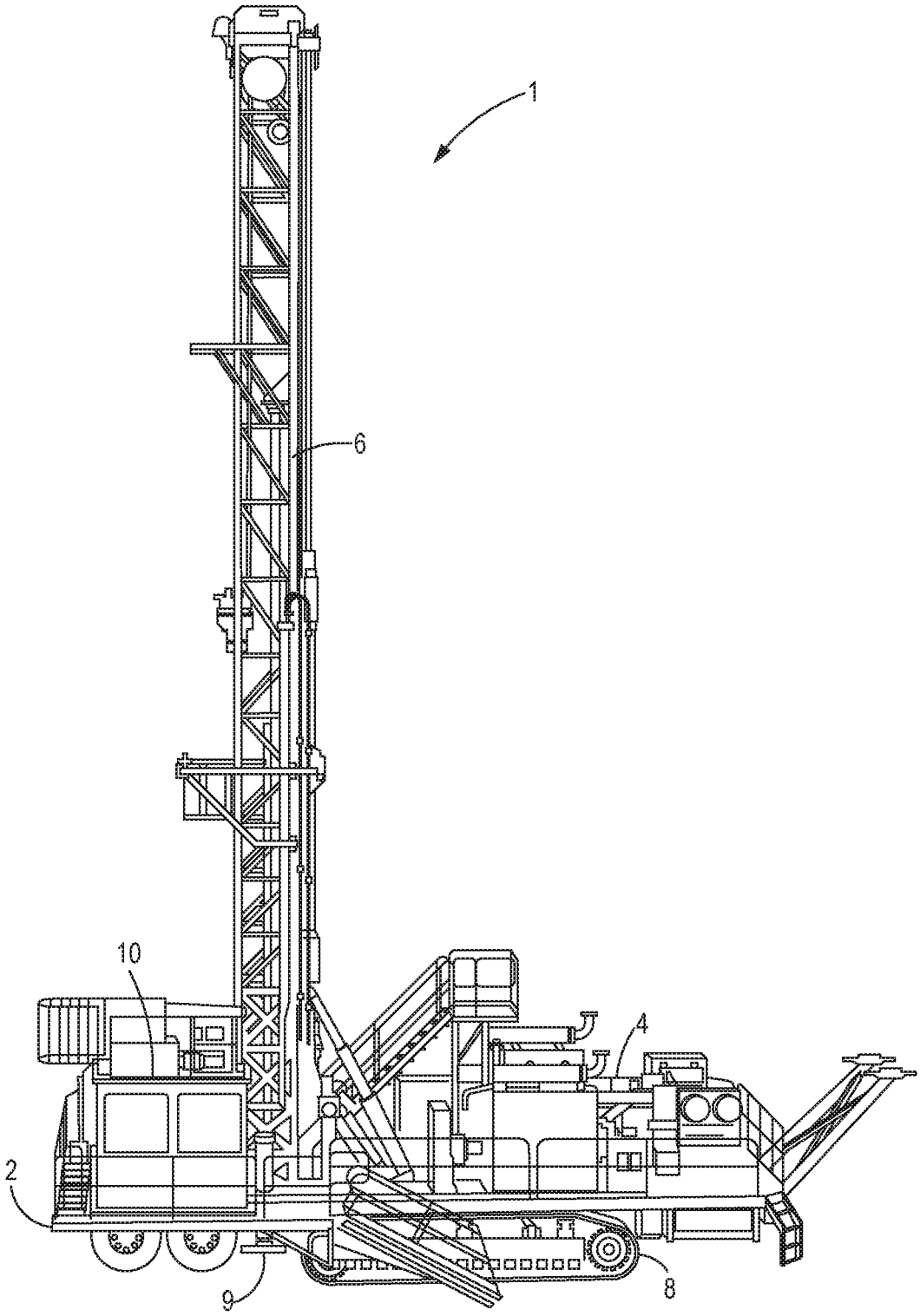
FIG. 1 is a side view of a mobile drilling machine, in accordance with one embodiment of the present disclosure.

Referring now to the drawings, and with specific reference to FIG. 1, an exemplary mobile drilling machine according to the present disclosure is referred to by reference numeral 1. Specifically, FIG. 1 depicts a rotary blasthole mobile drilling machine. As shown in FIG. 1, the rotary blasthole mobile drilling machine 1 includes a mobile frame 2, an engine 4, and a drill mast 6. The mobile frame 2 is supported on a ground surface by a transport mechanism 8, such as crawler tracks. The transport mechanism 8 allows the mobile drilling machine 1 to maneuver across a ground surface to a desired location for a drilling operation. The mobile frame 2 may further include one or more jacks 9 for supporting and leveling the machine 1 on the ground surface during the drilling operation. The mobile frame 2 also supports machinery such as motors, batteries, pumps, air compressors, hydraulic fluid storage (not shown) and any other equipment necessary to power and operate the mobile drilling machine 1 and not specifically numbered. The mobile frame 2 also supports an operator cab 10 from which a user or operator may maneuver and control the mobile drilling machine 1 via operator interfaces and displays not shown.

Figure 2:
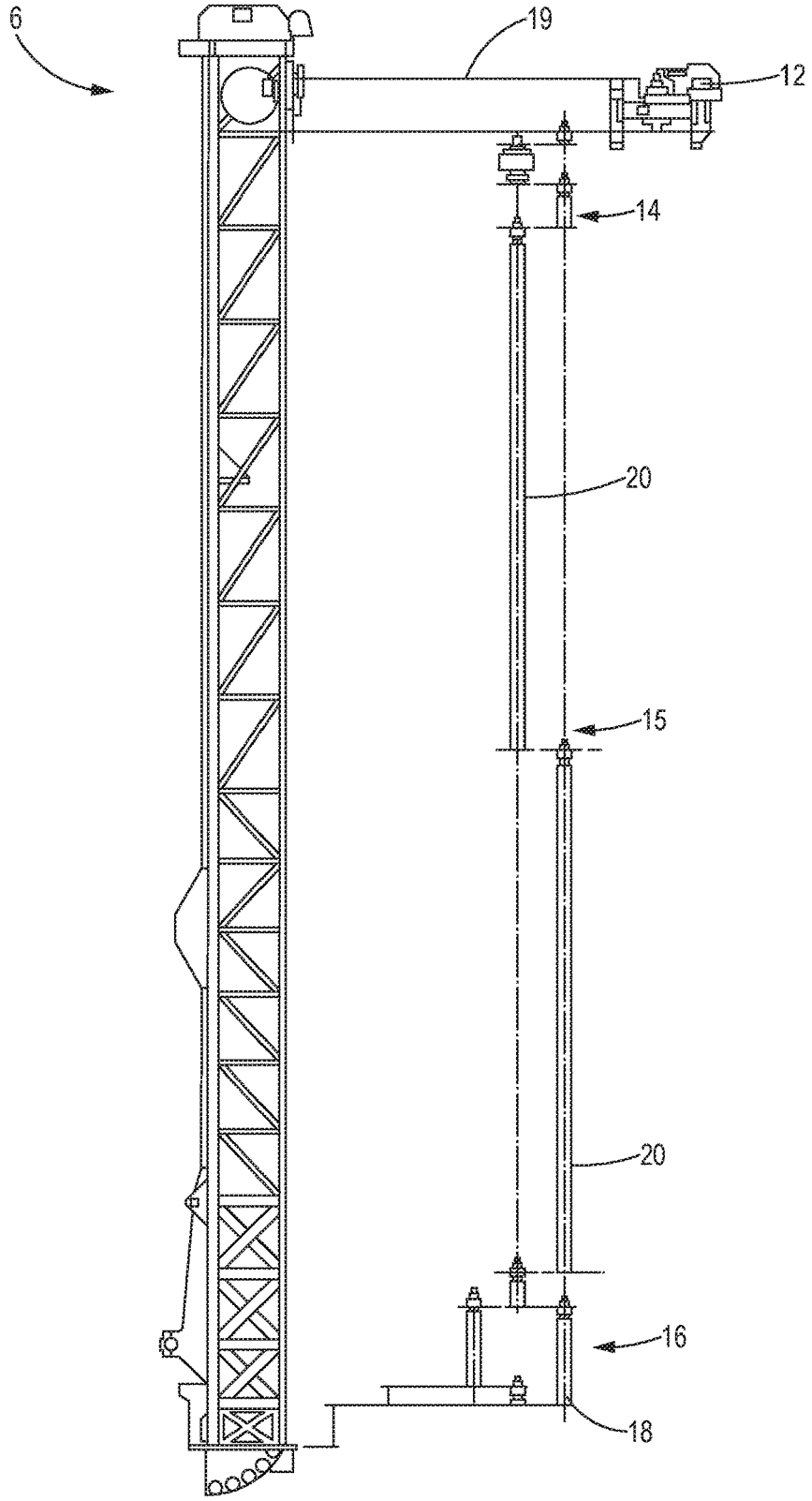
FIG. 2 is a diagrammatic side view of a drill mast for the mobile drilling machine of FIG. 1.

Referring now to FIGS. 2-5, with continued reference to FIG. 1, the components of the mobile drilling machine are explained. As best shown in FIG. 2, illustrated is a side view of the drill mast 6. The drill mast 6 supports a drill head 12. The drill head 12 is movably mounted on the mast 6 and couples to an upper end 14 of a drill string 15. A lower end 16 of the drill string 15 connects to a drill bit 18 or other drill tool. During operation of the mobile drilling machine 1, the drill head 12 rotates the drill string 15, thereby rotating the drill bit 18, through a passage hole 17 in a deck 21 of the mobile frame 2, in order to create a hole of the desired size and depth.

Hydraulic systems (not shown) or similar means may be used to rotate the drill string 15 from the drill head 12, and raise or lower the drill head 12 along the drill mast 6. These hydraulic systems can include electric pumps, valves, hydraulic cylinders, and hydraulic motors. The drill head 12 is hoisted and lowered along the drill mast 6 by a cable system 19 connected to a hydraulic cylinder (not shown). Controlling the extension of the hydraulic cylinder controls the height of the drill head 12. An operator can direct the hoisting and lowering of the drill head 12 from the operator cab 10 through a joystick or other similar means.

In another exemplary embodiment, electric systems (not shown) may be used to rotate the string 15 from the drill head 12, and raise and lower the drill head 12 along the drill mast 6. In an electric system, the drill head 12 is electrically driven by one or more electric motors (not shown). Further, in an electric system, the drill head 12 may be electrically fed power over a medium or higher voltage trailing cable. The drill head 12 is hoisted and lowered along the drill mast 6 by a cable system 19 connected to the one or more electric motors. Controlling the extension of the cable system 19 via the one or more electric motors controls the height of the drill head 12. An operator can direct the hoisting and lowering of the drill head 12 from the operator cab 10 through a joystick or other similar means.

Figure 3:
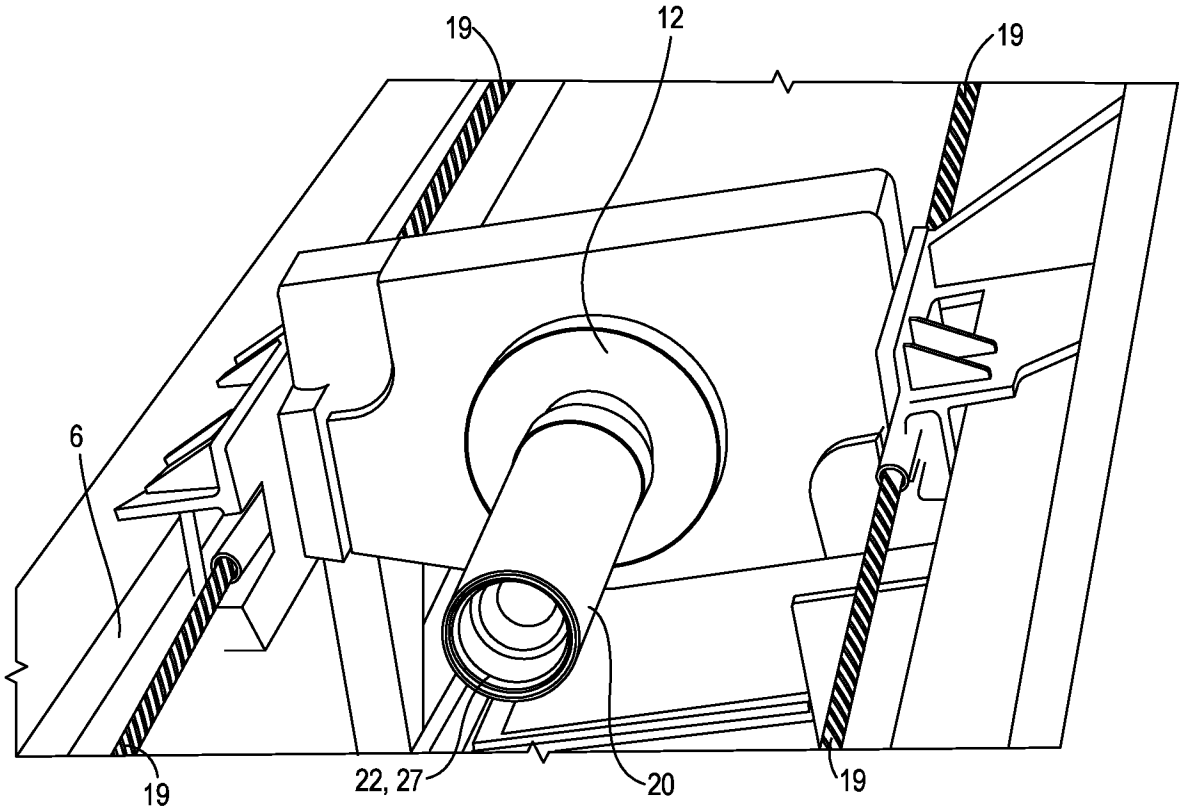
FIG. 3 diagrammatic illustration of the drill head for the mobile drilling machine of FIG. 1, according to aspects of the present disclosure.
Figure 4:
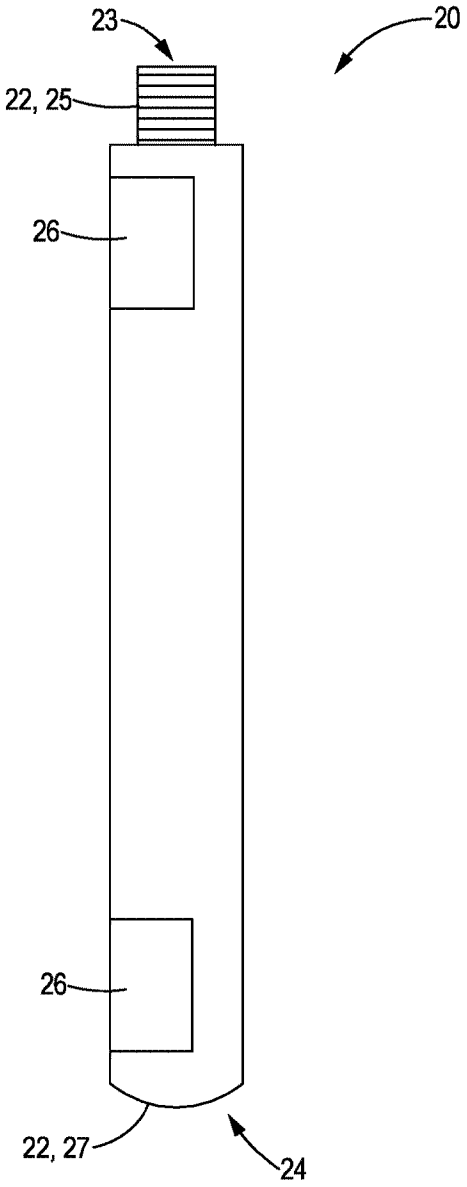
FIG. 4 is a side view of a drill string component for the mobile drilling machine of FIG. 1, according to aspects of the present disclosure.

Furthermore, in order to allow the drill string 15 to extend or shorten, the drill string 15 may be made up of a plurality of drill string components 20. An exemplary drill string component 20 is best depicted in FIG. 4. Each drill string component 20 has a threaded coupling 22 at each end. In one embodiment, the threaded coupling 20 at a top end 23 of each drill string component 20 may be a male threading 25 and the threaded coupling 22 at a lower end 24 of each drill string component may be a female threading 27 (as shown in FIG. 3). The drill string component 20 also has a slightly recessed flattened section 26 proximate to the threaded coupling 22 at both ends. This flattened section 26 allows for the drill string component 26 to be securely held such that rotation is prevented and vertical movement is restricted. In another embodiment, the drill string component 20 may be the drill bit 18.

Figure 5:
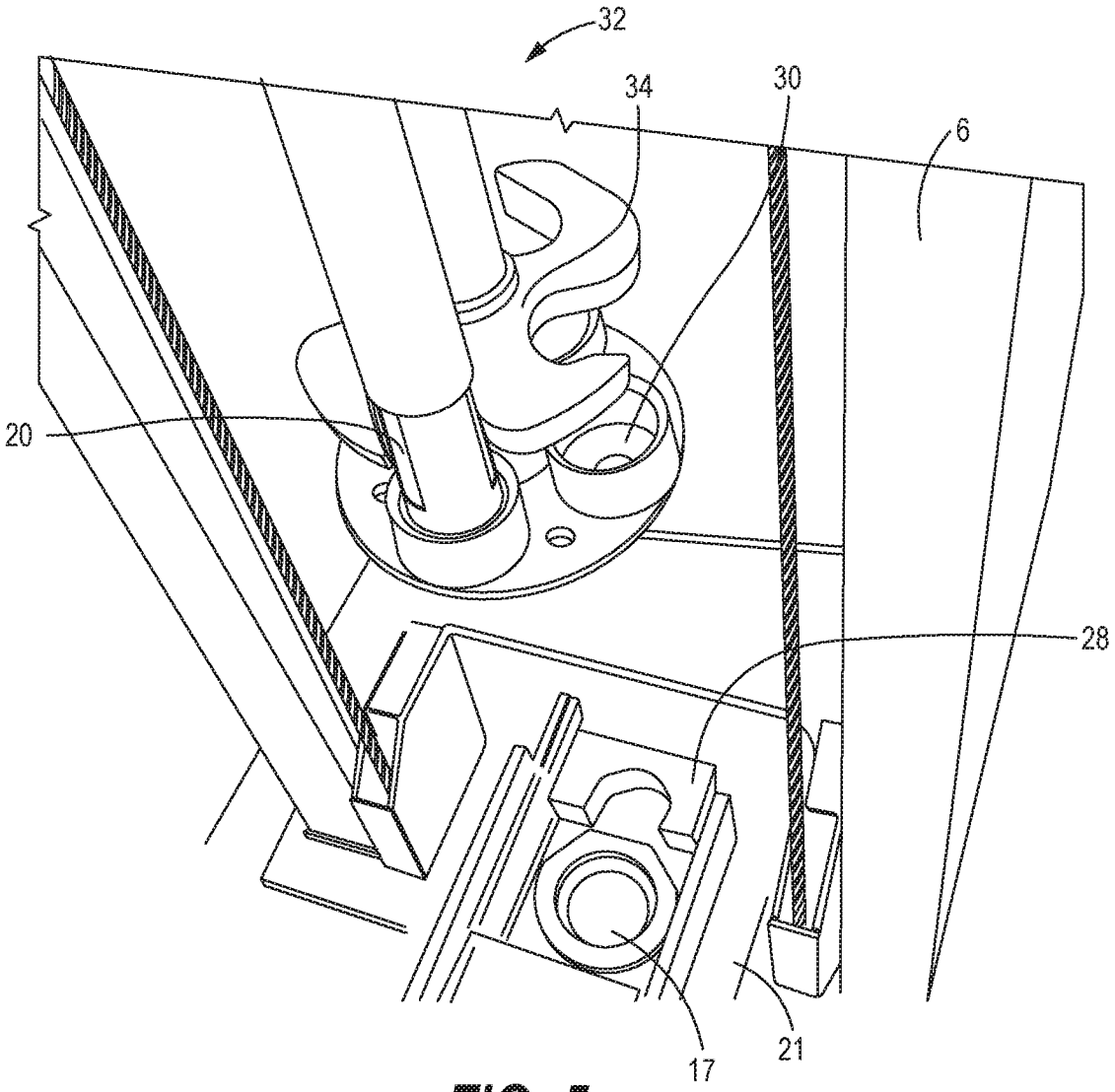
FIG. 5 is a diagrammatic illustration of an exemplary deck wrench and carousel for the mobile drilling machine of FIG. 1, according to aspects of the present disclosure.

FIG. 5 depicts a lower portion of the drill mast 6 of the mobile drilling machine 1 of FIG. 1 including a deck wrench 28 and a drill string component loading assembly 32. The deck wrench 28 is located at the bottom of the drill mast 6 and is configured to fit around a drill string component 20 at the recessed flattened section 26 to prevent rotation. The deck wrench 28 extends and moves into line with the drill string 15 and prevents rotation in order to allow the drill head 12 or drills string components 20 to be unscrewed from the lower end 16 of the drill string 15. The deck wrench 28 also holds the lower end 16 of the drill string 15 preventing it from dropping vertically. In one embodiment, a ridge created by the top of the flattened section 26 sits on top of the deck wrench 28.

Additional drill string components 20 are used for extending the drill string 15 to allow a deeper hole to be drilled. These additional drill string components 20 are each stored in a drill string component storage slot 30 in at least one drill string component loader assembly 32. The drill string component loader assemblies 32 are located on the drill mast 6 adjacent to the drill head 12 and aligned with the drill string 15. The drill string component loader assemblies 32 are configured to move a drill string component 20 in line with the drill head 12 and drill string 220. The pipe loader assemblies 300 can also take a removed drills string component 260 from the drill string 15 and move it into a drill string component slot 30. To aid in moving drill string components 20 and connecting them to the drill string 15, the drill string component loader assemblies 32 are configured to hold drill string components 20 securely at the recessed flattened section 26 and prevent rotation. In some embodiments, there may be multiple drill string component assemblies 32 located at different heights up the drill mast 6. Moreover, each drill string component loader assembly 32 has at least one drill string component storage slot 30. However, in some embodiments, a drill string component loader assembly 32 may have additional drill string component storage slots 30 in a rotating pipe carousel. This embodiment is depicted in FIG. 5.

Figure 7:
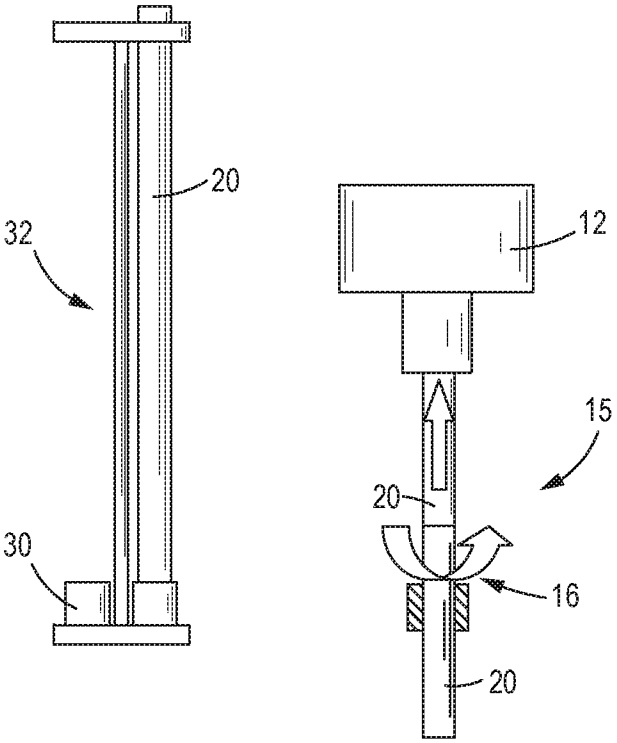
FIGS. 6-13 are schematic illustrations of the carousel of FIG. 5 in various stages of the drill string component addition process, according to aspects of the present disclosure.
Figure 6:
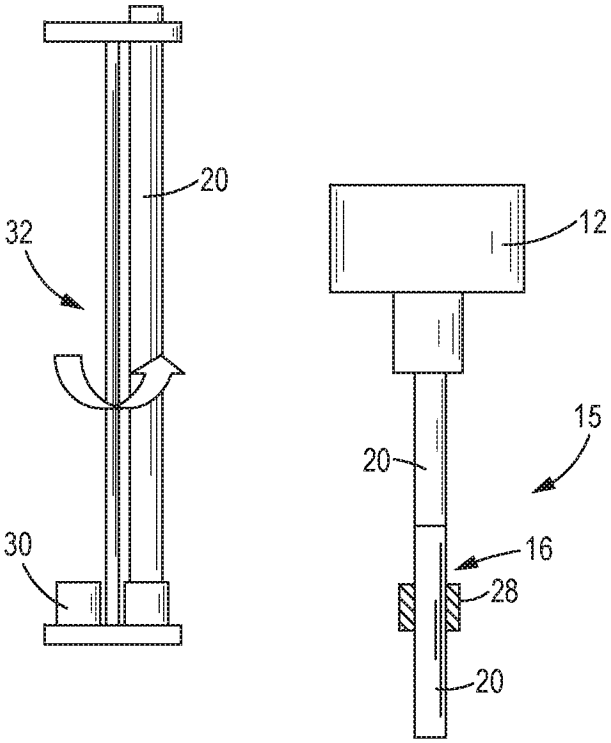
Figure 9:
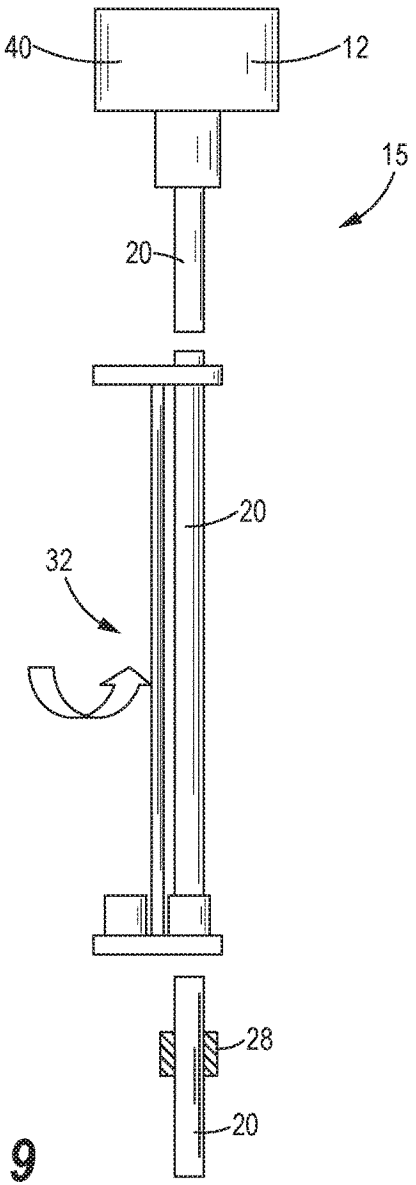
Figure 8:
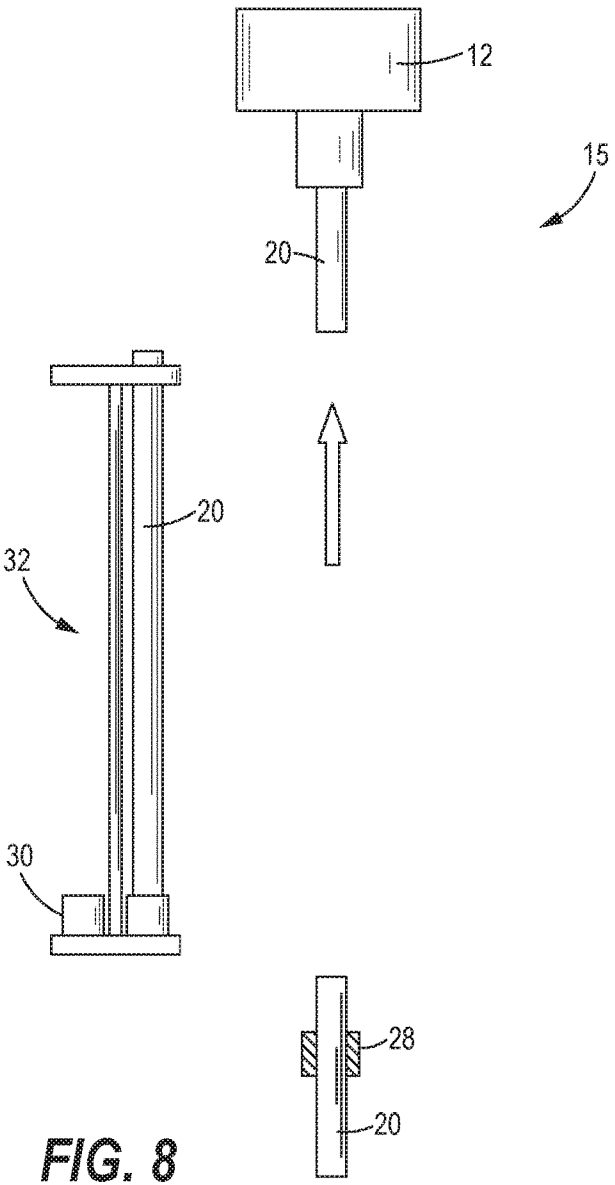
Figure 11:
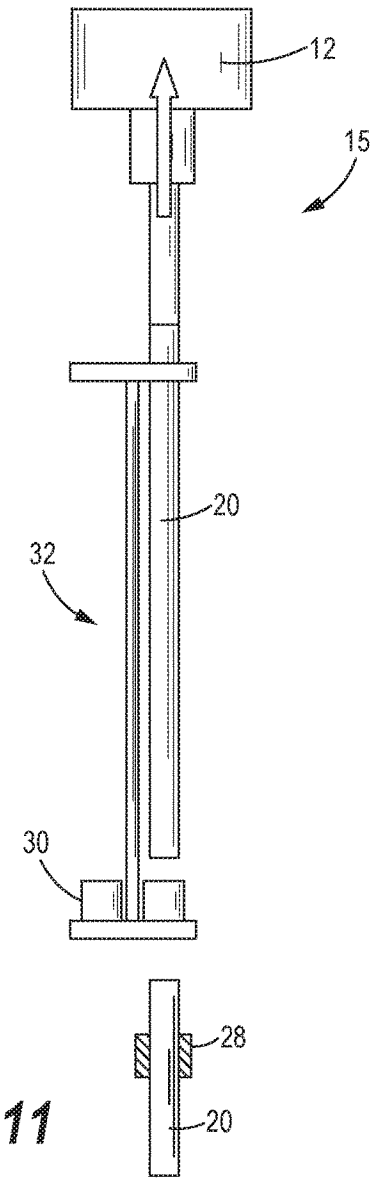
Figure 10:
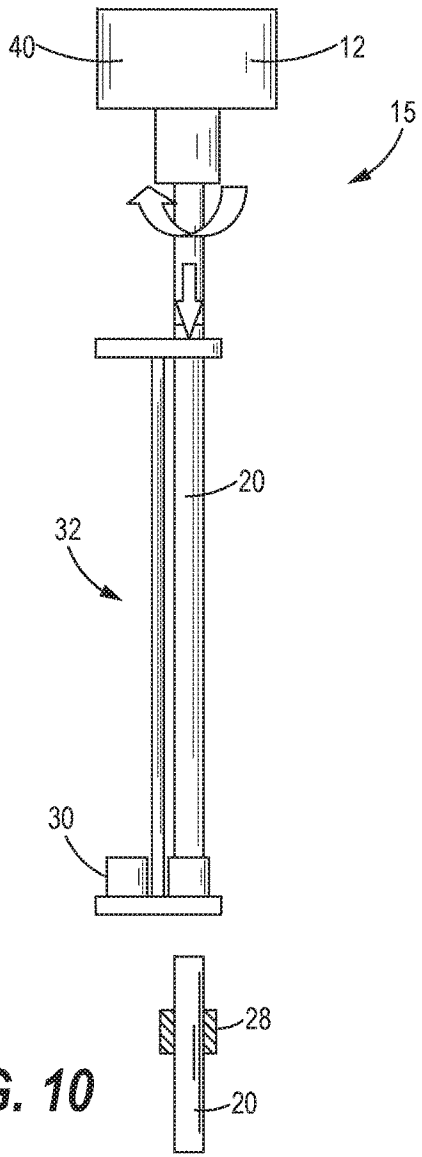

FIGS. 6-13 depict the sequence of steps taken when the drill string component 20 is added to the drill string 15. This operation takes place when the drill string 15 cannot reach to a desired hole depth. First, as shown in FIG. 6, the deck wrench 28 holds the lower end of drilling string 16, specifically a drill string component 20, securely at the recessed flattened section 26. If necessary, a drill string component loader assembly 32 will rotate to provide another drill string component 20. FIG. 7 depicts the separation of the drill head 12 and drill string component 20. This separation is achieved by rotating the drill head 12 while the drill string component 20 is held in place by the deck wrench 28. The drill head 12 moves upward as it unthread and decouples from the drill string 15. Next, the drill head 12 is hoisted up the drill mast 6 to a position above the drill string loader assembly 32 with a full drill string component slot 30, as shown in FIG. 8. FIG. 9 shows the drill string component loader assembly 32 moving the drill string component 20 into line with the drill head 12 and drill string 15. In the illustrated embodiment, the drill string component loader assembly 32 rotates into position. FIG. 10 depicts the drill head 12 moving down and rotating to securely screw into the drill string component 20.

Figure 13:
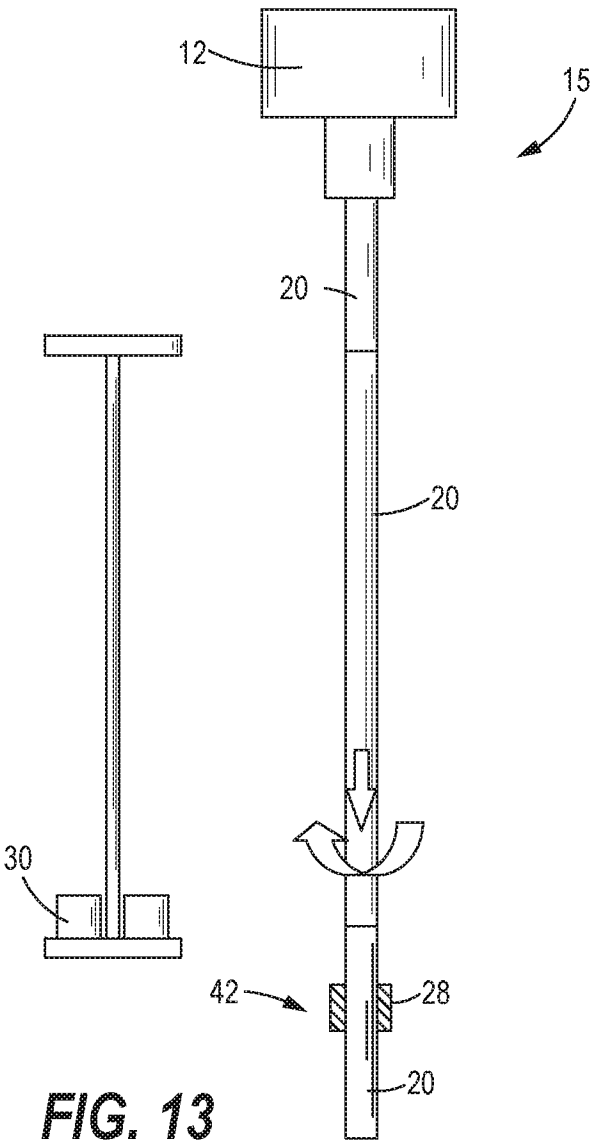
Figure 12:
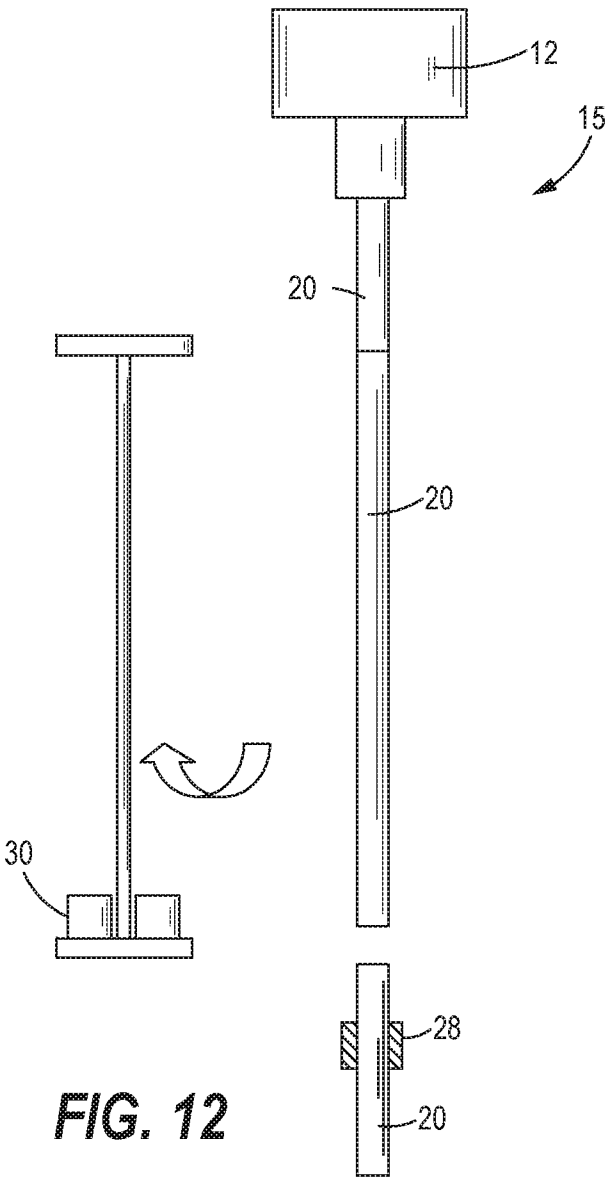

The drill string component loader assembly 32 prevents the drill string component 20 from rotating during this step by holding it at the recessed flattened section 26. This allows a secure connection. In some embodiments, sensor assemblies 40 in the drill head may monitor torque to prevent over-tightening. The drill head 12 and attached drill string component 20 are lifted upwards slightly (FIG. 11) lifting the drill string component 20 from the drill string component storage slot 30. This provides space for the drill string component loader assembly 32 to move back out of the drill string 15 (FIG. 12). Finally, as shown in FIG. 13, the drill head 12 and drill string component 20 are moved downwards and rotated in order to couple with the lower end 16 of the drill string 15. The deck wrench 28 holds the lower end 16 of the drill string 15 from rotating, creating a secure connection.

A very similar process is used in order to remove a drill string component 20 when drilling is complete. The drill head 12 and upper end 14 drill string component 20 are separated from the remainder of the drill string 15 and hoisted to a drill string component loader assembly 32 with an empty drill string component storage slot 30. The drill string component 20 is moved into the empty drill string component storage slot 30 and then disconnected from the drill head 12. The drill head 12 is then lowered and connected to the next drill string component 20 of the drill string 15.

During the engagement of the deck wrench 28 with the drill string components 20, it is important that the deck wrench 28 is not disengaged by retracting and becoming unconnected with the drill string component 20, a process also known as parking the deck wrench 28, before the drill head 12 is connected into, by screwing or other means, either directly, or indirectly by the upper end of drilling string 14, into the engaged drill string component 20. An engaged drill string component 20 is a drill string component 20 that is engaged by the deck wrench 28, and being held in place by said deck wrench 28. If an engaged drill string component 20 is accidentally disengaged by an operator before the drill head 12 connects to it, the disengaged drill string component 20 may fall down the drilled hole and be difficult to get out.

Figure 14:
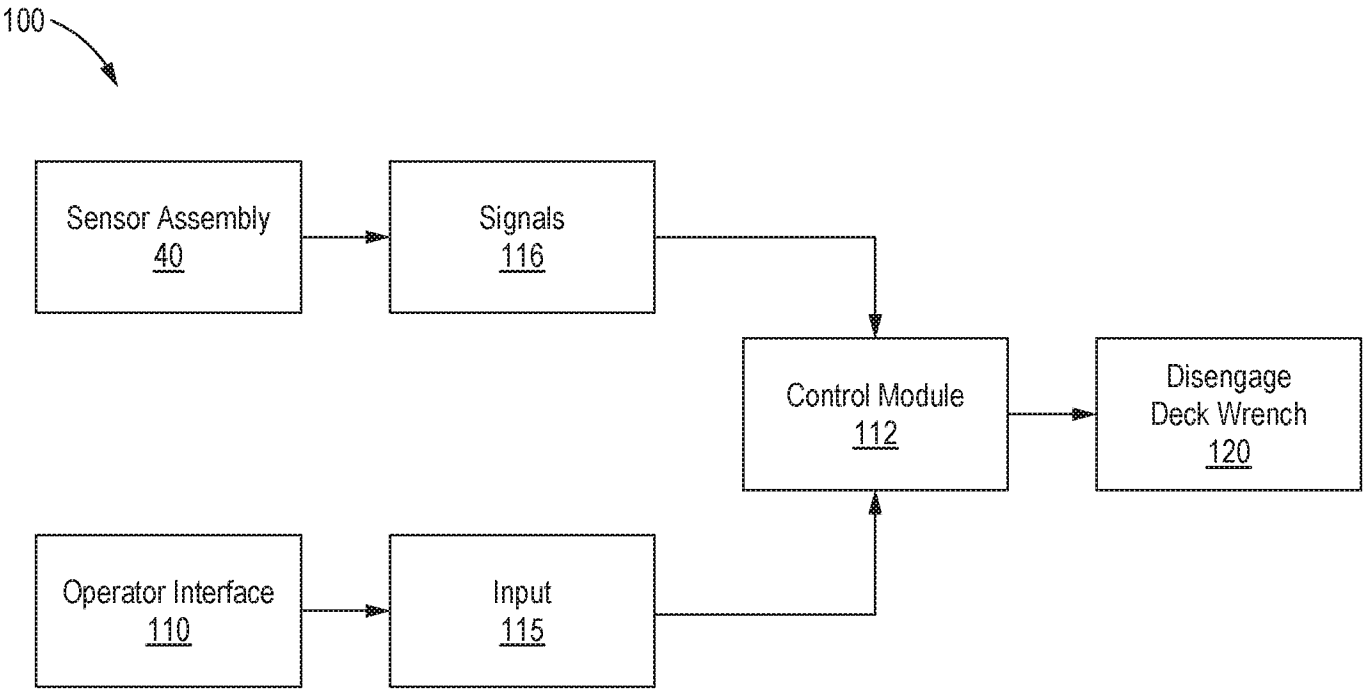
FIG. 14 is a schematic representation of the digital interlock system, according to an exemplary embodiment.

As depicted in FIG. 14, the interlock system 100 includes a sensor assembly 40, an operator interface 110, and a control module 112. The sensor assembly 40 is configured to determine a drill string status 114. The drill string status 114 is statuses of what drill string components 20 are connected in the drill string 15, and may also indicate whether a drill string component 20 is being added or removed, based on whether the drill string 15 is separated at the drill head 12 or below the first drill string component 20. The drill string components 20 may be the pipe like segments described above, or the drill bit 18 if that is the component being added or removed from the drill string 15.

The operator interface 110 is configured to receive the deck wrench disengagement input 115 from an operator to disengage the deck wrench 28 from an engaged drill string component 20.

The control module 112 is configured to receive signals 116 from the sensor assemblies 40 and the deck wrench disengagement input from the operator interface 110. The control module 112 is further configured to take the signals 116 and input 115 and determine if the drill string component 20 engaged by the deck wrench 28 is connected to directly the drill head 12, or connected to the drill string 15 that is connected to the drill head 12. If the drill string status 114 indicates that a drill string component 20 engaged by the deck wrench 28 is not connected to the drill string 15 or directly to the drill head 12, the control module 112 prevents the disengagement and retraction of the deck wrench 28 so the engaged drill string component 20 does not fall into the drill hole. If the drill string status indicates that the drill string component 20 engaged by the deck wrench 28 is directly connected to the drill head 12, or the drill string 15 that is connected to the drill head 12, then the control module disengages the deck wrench 120.

The sensor assembly 40 may be configured to determine the drill string status 114. The sensor assembly may include at least one of a pressure sensor, a rotation sensor, or a drill head sensor (not shown).

The drill head sensor may be located in the drill head 12, and utilized to measure if the drill head is at an attached position. The attached position may be a minimum height of the drill head 12 on the drill mast 6 where the drill head 12 is connected to, either directly or indirectly through one or more drill string components 20, the drill string component 20 engaged by the deck wrench 28. The attached position may also be a minimum drill head 12 height in which the one or more drill string components 20 of the drill string 15 are connected.

The rotation sensor may be a sensor used to measure the torque of the drill head when it screws together the one or more drill string components 20 that makes up the drill string 15.

A pressure sensor may measure a hydraulic fluid pressure in the hydraulic system, and the hydraulic system may be used to move the drill head 12. The pressure sensor may further be used to determine the drill string status 114 from the measurement of the hydraulic fluid pressure.

INDUSTRIAL APPLICABILITY

In general, the foregoing disclosure finds utility in various applications, such as, in earthmoving, construction, industrial, agricultural, mining, transportation, and forestry machines. In particular, the disclosed interlock system may be used by mobile drilling machines and other applications, such as, a blasthole mobile drilling machines and the like. By applying the disclosed interlock system to a mobile drilling machine, prevention of the loss of a drill string in a drill hole may be achieved.

Figure 15:
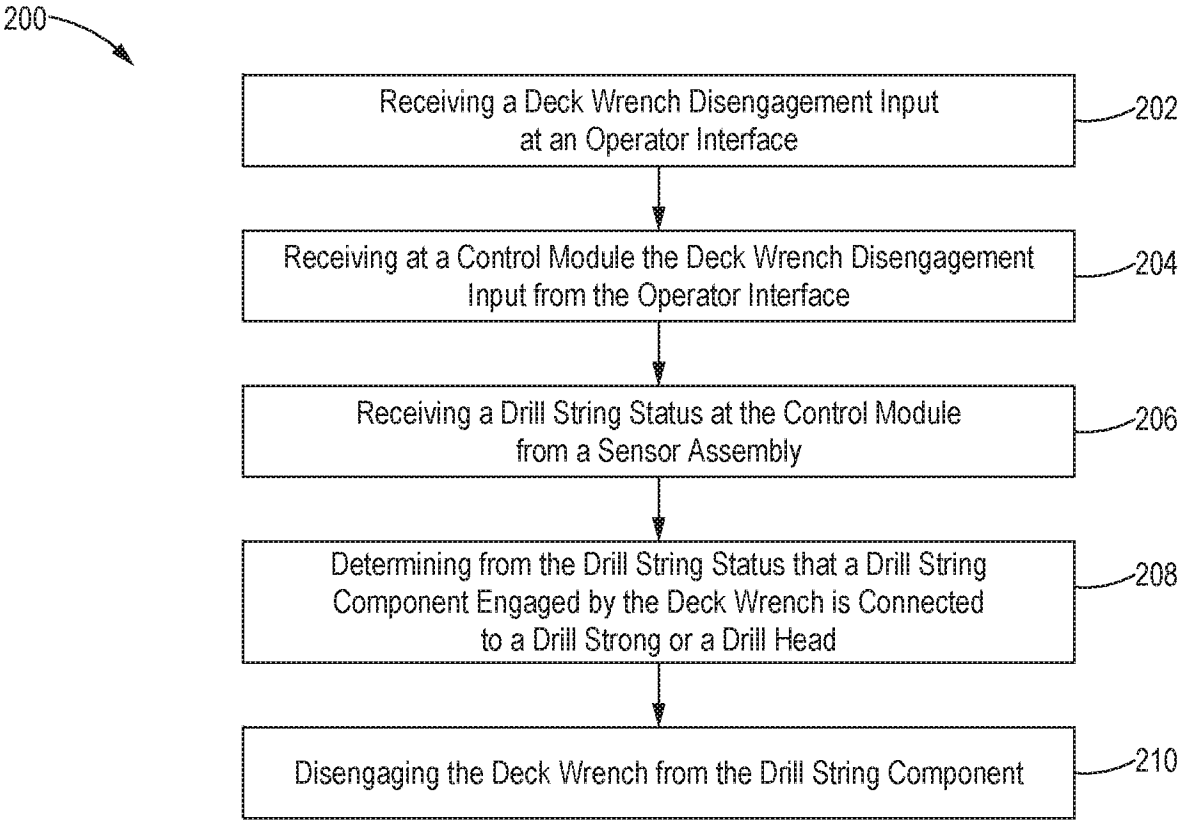
FIG. 15 is a flow chart representation of a method of providing a digital interlock for a mobile drilling machine.

During the disengagement of the deck wrench from a drill string, or more particularly, the drill string components that form a drill string, the prevention of the accidental disengagement of a drill string component that may not be securely attached is essential. Turning now to FIG. 15, with continued references to FIGS. 1-14, a flow chart illustrating an example method 200 for providing a digital interlock for a mobile drilling machine 100 is provided. At block 202, the deck wrench disengagement 115 input is received at the operator interface 110. An operator, wishing to park the deck wrench 28, will input the disengagement input at the operator interface. At block 204, the control module 112 receives the deck wrench disengagement input 115 as a signal, but will not yet disengage the deck wrench.

The control module 112 will request, and receive at block 206, a drill string status from a sensor assembly 40. The sensor assembly 40 is comprised of one or more sensors that are used to determine if the drill string component 20 that is engaged by the deck wrench 28 is indeed connected to the drill head 12, or other drill string components 20 that are connected to the drill head 12, so if the deck wrench 28 is disengaged, the drill string will not fall into the drill hole. This is determined at block 208 from the drill string status

114. Once this is determined, the deck wrench 28 disengages from the drill string component 20 that it is directly engaged with.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. An interlock system for a mobile drilling machine, comprising:

a sensor assembly configured to determine a drill string status, the sensor assembly including a pressure sensor;

an operator interface configured to receive a deck wrench disengagement input; and a control module configured to:

receive the deck wrench disengagement input from the operator interface, receive the drill string status from the sensor assembly, determine from the drill string status that a drill string component engaged by a deck wrench is connected to a drill string or a drill head, and disengage the deck wrench from the drill string component engaged by the deck wrench, wherein the pressure sensor measures a hydraulic fluid pressure in a hydraulic system, the hydraulic system being utilized to move the drill head, and the pressure sensor determines the drill string status from the measurement of the hydraulic fluid pressure.

2. The interlock system of claim 1, in which the drill string component engaged by the deck wrench is one drill string component of a group of one or more drill string components that comprises the drill string and the drill string status is a status of what drill string components of the group are connected.

3. The interlock system of claim 2, in which the one or more drill string components are a drill string component or drill tool.

4. The interlock system of claim 2, in which the sensor assembly includes a rotation sensor.

5. The interlock system of claim 4, in which the one or more drill string components screw into each other to connect, a top drill string component of the one or more drill string components screws into the drill head, and the rotation sensor makes a torque measurement to determine the drill string status.

6. The interlock system of claim 2, in which the sensor assembly includes a drill head sensor, the drill head sensor measures if the drill head is at an attached position, and the attached position being a minimum drill head height in which the one or more drill string components of the drill string are connected.

7. The interlock system of claim 2, in which prior to receiving the deck wrench disengagement input, one of the one or more drill string components is engaged with the deck wrench.

8. The interlock system of claim 2, in which the deck wrench engages one of the one or more drill string components by attaching to and holding in place one of the one or more drill string components.

9. The interlock system of claim 1, in which the drill string status further includes whether each of the one or more drill string components are screwed into another of the one or more drill string components at their top or bottom.

10. A mobile drill machine, comprising:

a mobile frame;

a drill mast mounted on the frame;

a drill head movably mounted on the mast;

a drill string coupled to the drill head and aligned with the mast;

a deck wrench mounted on the frame configured to engage the drill string;

an interlock system, the interlock system including, a sensor assembly configured to determine a drill string status, the sensor assembly including a drill head sensor, an operator interface configured to receive a deck wrench disengagement input, and a control module configured to receive the deck wrench disengagement input from the operator interface, receive the drill string status from the sensor assembly, determine from the drill string status that a drill string component engaged by the deck wrench is connected to a drill string or a drill head, and disengage the deck wrench from the drill string component engaged by the deck wrench, wherein the drill head sensor measures if the drill head is at an attached position, and the attached position being a minimum drill head height in which the one or more drill string components of the drill string are connected.

11. The mobile drill machine of claim 10, in which the drill string status indicated that the drill string component engaged by the deck wrench is directly connected at a top of the drill string component engaged by the deck wrench to another drill string component.

12. The mobile drill machine of claim 10, in which the deck wrench is located on a deck of the frame, and the deck wrench engages the component of the drill string component by extending and clamping onto the drill string component.

13. The mobile drill machine of claim 12, in which prior to the deck wrench engaging the drill string component, the drill head raises the drill string component into a pass through hole on the deck.

14. The mobile drill machine of claim 10, in which after the control module receives the deck wrench disengagement input from the operator interface the drill head connects to the drill string component.

15. The mobile drill machine of claim 14, in which the drill head connects to the drill string component by screwing into it.

* * * * *